US005657868A

United States Patent [19]

Taylor

[11] Patent Number: 5,657,868

[45] Date of Patent: Aug. 19, 1997

[54] FLORAL DELIVERY BOX APPARATUS

[76] Inventor: William E. Taylor, 12747 Independence, Shelby Township, Macomb County, Mich. 48315

[21] Appl. No.: 561,955

[22] Filed: Nov. 22, 1995

[51] Int. Cl.[6] ..... B65D 85/52

[52] U.S. Cl. ..... 206/423; 47/84; 248/152

[58] Field of Search ..... 47/39 P, 41.14, 47/84; 206/423, 426; 229/164; 248/152, 346.03, 346.4, 346.5

[56] References Cited

U.S. PATENT DOCUMENTS

| | | | |
|---|---|---|---|
| 2,264,489 | 12/1941 | Tiegler et al. | 248/152 |
| 2,501,675 | 3/1950 | Grunewald | 47/39 P |
| 3,297,289 | 1/1967 | Raus | 248/152 |
| 4,078,658 | 3/1978 | Neiser | 206/423 |
| 4,184,595 | 1/1980 | Wackerman | 206/423 |
| 4,248,347 | 2/1981 | Trimbee | 206/423 |
| 4,741,440 | 5/1988 | Harris | 206/423 |
| 5,060,798 | 10/1991 | Braastad | 206/423 |

FOREIGN PATENT DOCUMENTS

| | | | |
|---|---|---|---|
| 20275 | 7/1910 | United Kingdom | 248/152 |
| 1594053 | 7/1981 | United Kingdom | 229/164 |

OTHER PUBLICATIONS

First Generic Floral Delivery Box product, dated at least as early as Nov. 22, 1995, a perspective view photograph being supplied.

Second Generic Floral Delivery Box product, dated at least as early as Nov. 22, 1995, a side view photograph being supplied.

*Primary Examiner*—Jimmy G. Foster
*Attorney, Agent, or Firm*—Peter D. Keefe

[57] ABSTRACT

A floral delivery box apparatus which provides protection of a floral arrangement associated therewith from being damaged while carried or damaged from tipping during delivery and further allows for floral wrapping thereof, composed of a box member and a base member. The base is provided with a plurality of wings which are connected by stapling to the side walls of the box. The box is configured to receive the pot of a floral arrangement, and the base is configured to provide a planar surface having an area much larger than that of the box. In this regard, the box serves as a receptacle to restrain lateral movement of the floral arrangement with respect to the base, and the base serves as an anti-tipping member, where a sufficiently large lever arm between the center thereof and the edge of the base is such that the floral arrangement is immune to tipping over during normally encountered inertial forces of transportation by a motor vehicle. The material of choice for the base and the box is stiff flat corrugated paper stock material having pre-cut edges and pre-formed fold-lines. Preferably, the stock material of the box is provided with a pair of slots in the bottom wall adjacent opposing side walls for receiving therethrough the wings of the base.

18 Claims, 4 Drawing Sheets

FLORAL DELIVERY BOX APPARATUS

BACKGROUND OF THE INVENTION

1. Field of the Invention

The present invention relates to floral delivery boxes used in the process of delivering floral arrangements. More particularly, the present invention relates to a floral delivery box apparatus which is easily set-up and which provides resistance to accidental tipping of a floral arrangement partly resident therein during the delivery process.

2. Description of the Prior Art

Floral arrangements prepared by florists are typically composed of a floral arrangement set into a pot. The pot serves to retain moisture and hold other materials, such as soil or a porous mass, into which roots or stems of the floral items of the floral arrangement are planted or inserted. Much time and artistry are involved in the selection of floral items and their exact relative positioning in order to achieve a floral arrangement having maximum beauty.

Since invariably the floral arrangement must be transported from the florist to the recipient, either by a delivery service or by the purchaser, great care must be taken in order to preserve the integrity of the floral arrangement all during the delivery process. There are several major considerations which must be taken into account when a floral arrangement is to be transported, among these are ability of the floral arrangement to be handled, protection of the floral arrangement from becoming disheveled, and minimization of the chance for the floral arrangement being tipped over.

Florists utilize a conventional floral delivery box which is configured from flat, stiff corrugated paper stock material having been provided with a pre-cut edge and preformed fold-lines which enable the florist to fold tabular portions thereof into a box, wherein the tabular portions are stapled together. The box thereby provided has four side walls and a bottom wall, wherein the top opposite the bottom wall is open. The florist then places the pot of the floral arrangement into the floral delivery box via its open top. The florist then wraps the floral arrangement and floral delivery box combination in floral wrapping composed of plastic, paper or other wrap material to thereby provide a barrier to dishevelment of the floral arrangement. The floral arrangement can be handled by grasping of the box, but typically the floral arrangement is so much larger than the box that this is difficult; therefore, frequently the floral arrangement is picked-up by the floral wrapping, which is clearly not a good practice since damage to the floral arrangement may occur.

While the above recounted conventional floral delivery box and the floral wrapping therefor have been used for years by florists, there yet remains the very real and significant problem of damage to the floral arrangement due to accidental tipping thereof during transportation. Certainly, the conventional floral box can offer very little to no inherent stability for the floral arrangement against tipping due to inertial forces generated during the driving of a motor vehicle. Alternatively, it is damaging to abut the flowers of the floral arrangement against some object in an effort to prevent the floral arrangement from tipping due to inertial forces generated during the driving of a motor vehicle. Accordingly, what is needed in the art is a floral delivery box which somehow offers protection of its floral arrangement from tipping during delivery, allows for the floral arrangement to be picked-up without risk of injury thereto, and yet allows for floral wrapping in a manner already in vogue by florists.

SUMMARY OF THE INVENTION

The present invention is a floral delivery box apparatus which provides protection of a floral arrangement associated therewith from tipping during delivery, allows for the floral arrangement to be picked-up without risk of injury thereto, and further allows for floral wrapping thereof.

The floral delivery box apparatus according to the present invention includes a box member and a base member, wherein the base is provided with a plurality of wings which are connected with the side walls of the box to thereby conjoin the box with respect to the base. The box is configured to receive the pot of a floral arrangement, and the base is configured to provide a planar surface having an area much larger than that of the box. In this regard, the box serves as a receptacle to restrain lateral movement of the floral arrangement with respect to the base, and the base serves as an anti-tipping member, wherein a sufficiently large lever arm between the center thereof and the edge of the base is such that the floral arrangement is immune to tipping over during normally encountered inertial forces of transportation by a motor vehicle.

The box according to the present invention is formed from stiff, flat stock material, preferably corrugated paper stock material, having a pre-cut edge and pre-formed fold-lines. Tabular portions of the stock material of the box are up-folded and partly overlapped to thereby provide locations for stapling, whereupon the box is fixed into a bottom wall, four side walls and an open top configuration for receiving thereinside the pot of a floral arrangement. Preferably, the stock material of the box is provided with a pair of slots in the bottom wall adjacent opposing side walls.

The base according to the present invention is formed from stiff, flat stock material, preferably corrugated paper stock material, having pre-cut edges and a plurality of wings defined by pre-cut scores and fold-lines which are preferably pre-formed. Preferably, a number of pairs of wings are provided, wherein each pair of wings provides connection with respect to the side walls of a predetermined size of box.

In operation, the florist assembles the box, up-folds the appropriate pair of wings and then staples the wings to opposing side walls of the box which abut, respectively, the wings. In the most preferred form of practice of the present invention, the wings are inserted through the slots of the bottom wall and thereupon stapled to the inside of the abutting side walls. The corners of the base are rounded, thereby allowing floral wrapping to be placed about the entire combination of the floral delivery box apparatus and the floral arrangement associated therewith, wherein the rounded corners eliminate the chance of tearing of the floral wrapping at the corners of the base.

Accordingly, it is an object of the present invention to provide a floral delivery box apparatus which provides protection against accidental tipping of the floral arrangement associated therewith during transportation.

It is another object of the present invention to provide a floral delivery box apparatus which provides protection against accidental tipping of the floral arrangement associated therewith during transportation, wherein assembly thereof is simple and easy.

It is an additional object of the present invention to provide a floral delivery box apparatus which provides protection against accidental tipping of the floral arrangement associated therewith during transportation, wherein floral wrapping is placeable thereover without being subjected to tearing.

It is a further object of the present invention to provide a floral delivery box apparatus which provides protection against accidental tipping of the floral arrangement associated therewith during transportation, wherein assembly thereof is adaptable to a variety of sizes of boxes.

It is yet another object of the present invention to provide a floral delivery box apparatus which provides for the floral arrangement to be picked-up without risk of injury thereto.

These, and additional objects, advantages, features and benefits of the present invention will become apparent from the following specification.

DETAILED DESCRIPTION OF THE PREFERRED EMBODIMENT

Figure 1:
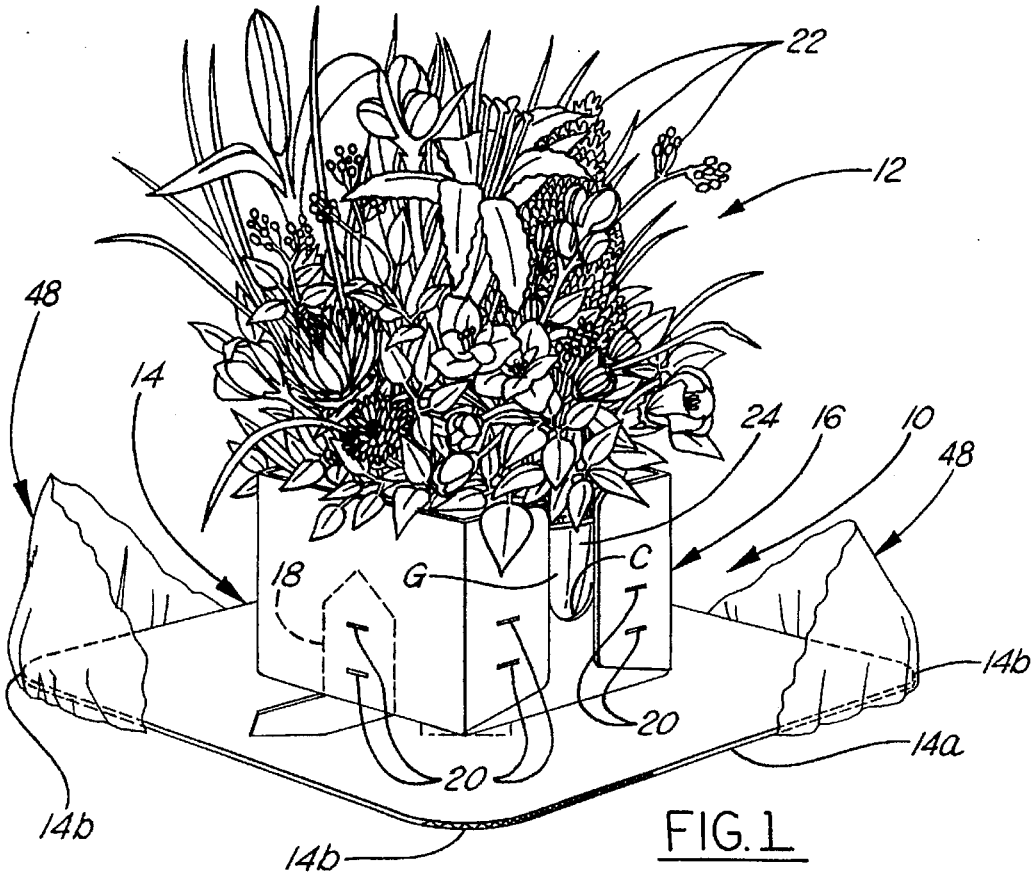
FIG. 1 is a perspective view of the floral delivery box apparatus according to the present invention, shown in operation with a floral arrangement.

Referring now to the Drawing, FIG. 1 shows the floral delivery box apparatus 10 according to the present invention in operation in connection with a floral arrangement 12. The floral delivery box apparatus 10 includes, generally, two members: a base 14 and a box 16. The base 14 and the box 16 are connected together by wings 18 which are integrally connected to the base and stapled to the box by staples 20. Both the base 14 and the box 16 are preferably formed from stiff corrugated paper flat stock material, popularly known as "corrugated cardboard" of the kind commonly used in the box industry. The floral arrangement 12 includes, generally, floral items 22 which are interconnected with, or placed into, a pot 24. The floral delivery box apparatus 10 provides a stable platform for transportation of the floral arrangement 12 whereby the pot 24 is received into the box 16. The base 14 has a large surface area so that the perimetical edge 14*a* thereof is spaced sufficiently from the center thereof and outwardly from the box that: 1) the floral arrangement is graspable at the perimetrical edge and easily and safely carried without injury to the floral arrangement, and 2) tipping of the floral arrangement 12 due to inertial forces generated during delivery thereof via a motor vehicle is essentially impossible. Further, should the floral arrangement 12 and its associated floral delivery box apparatus 10 slide within a conveyance during transportation, the perimetrical edge 14*a* will impact with a surrounding object at ground level without the floral arrangement, itself, impacting.

Figure 2:
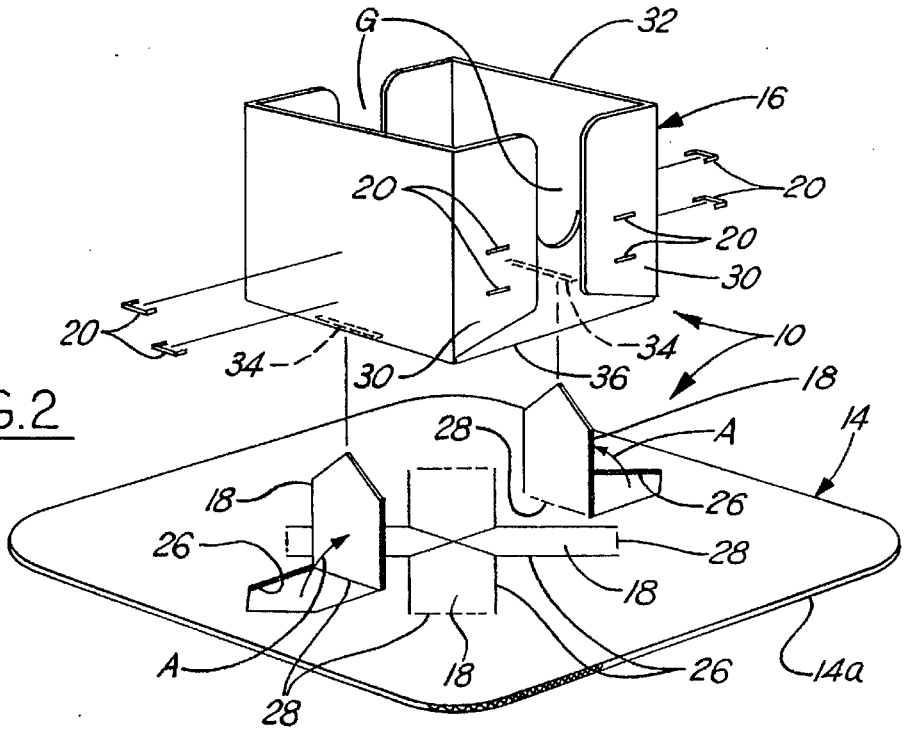
FIG. 2 is a perspective exploded view of the floral delivery box apparatus according to the present invention.

An overview understanding of the structure of the floral delivery box apparatus 10 can be obtained by reference to FIG. 2. The base 14 includes at least one pair of wings 18 which are formed from the stock material of the base via scoring 26 and a fold-line 28, which may or may not be pre-formed, at the terminous of the scoring. The florist up-folds each of the wings 18 at the fold-line thereof along arrows A, as shown in FIG. 2. The box 16 is formed by folding the stock material thereof and connecting together overlapping portions 30 of the side walls 32 via staples 20. In the preferred form of the box 14, a pair of slots 34 are provided in the bottom wall 36 of the box at opposing sides thereof adjacent the side walls. The box 16 is connected to the base 14 via each of the wings 18 passing through a respective slot 34 until the bottom wall 36 rests upon the base. Thereupon, the wings 18 are stapled to the respectively abutting side walls 32.

The structure and function of the floral delivery box apparatus 10 will now be detailed with greater specificity, with reference being additionally directed to remaining FIGS. 3 through 9B.

Figure 3:
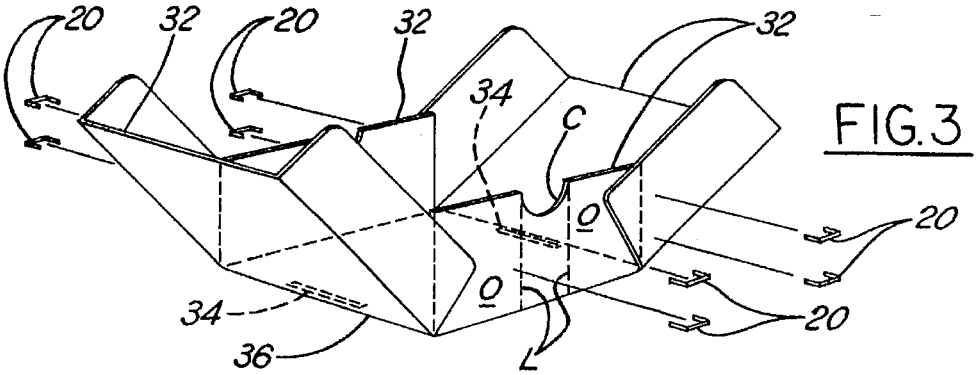
FIG. 3 is a perspective view of the box of the floral delivery box apparatus according to the present invention, where the box is shown in mid-assembly.
Figure 4:
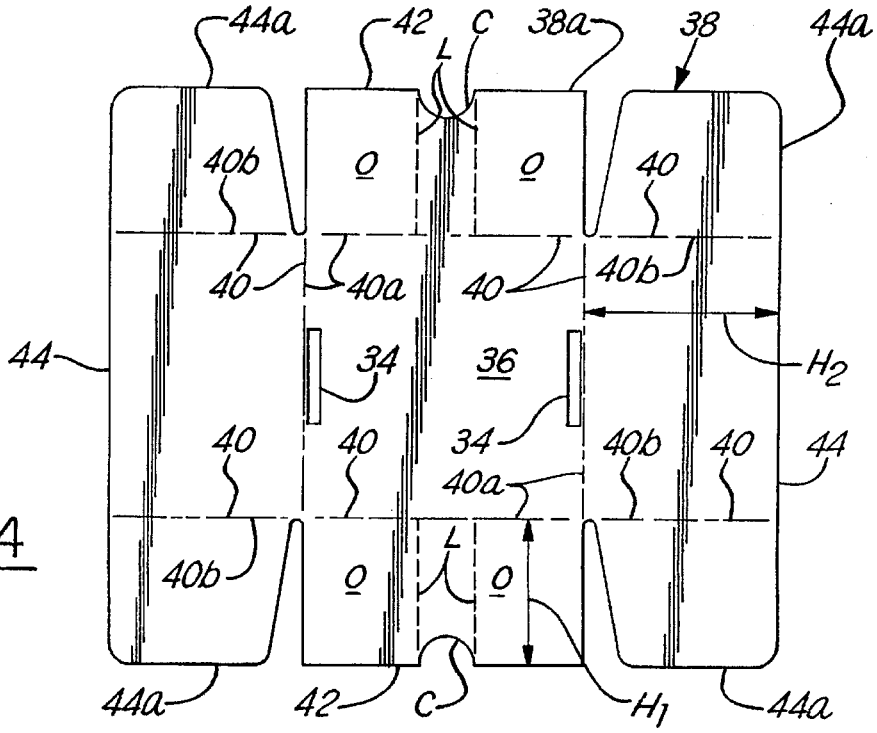
FIG. 4 is a top plan view of the flat stock for forming the box of the floral delivery box apparatus according to the present invention.

FIGS. 3 and 4 refer to the structure of the preferred form of the box 16 (as depicted in FIGS. 1 and 2). As shown by FIG. 4, the box 16 is formed from stiff flat stock material, hereinafter referred to as box stock material 38. Preferably, the box stock material 38 is composed of standard corrugated paper material of the kind used ubiquitously in the packaging art for boxes. Of course, other materials could be used for the box stock material 38, whether corrugated or noncorrugated, including for example plastic or wax coated corrugated paper stock material or corrugated plastic stock material.

The box stock material 38 is provided with a pre-cut edge 38*a* which is predetermined to provide the box 16 when folded along pre-formed fold-lines 40. In this regard, a bottom wall fold-line 40*a* demarcates the bottom wall 36 from the first and second pairs of side wall tabs 42, 44. Each side wall tab of the second pair of side wall tabs 44 also includes a pair of overlap tabs 44*a* demarcated by an overlap tab fold-line 40*b*.

As shown in FIG. 3, the side walls 32 are formed by up-folding the first and second pairs of side wall tabs 42, 44, wherein the overlap tabs 44*a* of the second pair of side wall tabs 44 overlap at an overlap area O of the first pair of side wall tabs 42 as indicated by the imaginary dashed line L. The staples 20 attach the overlap tabs 44*a* to the first pair of side wall tabs 42 to thereby fix the first and second pairs of side wall tabs 42, 44 into the configuration of the box 16 at the aforementioned overlapping portions 30.

It is preferred for the non-overlap area of the first side wall tabs 42 to be provided with a concave shaped relief C. The first pair of side wall tabs 42 has a height $H_1$ which is less than the height $H_2$ of the second pair of side wall tabs 44, and the overlap tabs 44*a* are dimensioned so as to be mutually separated when folded overlappingly at each side wall tab of the first pair of side wall tabs. Accordingly, a vertical gap G is provided in opposing side walls which include the first pair of side wall tabs 42. The vertical gap G is at least ¾ inch wide (preferably between 1 inch and two inches) to thereby enable the fingers and/or thumb of a florist to be placed therein while the florist places the pot 26 of a floral arrangement 12 into the box 16 while holding onto the pot at all times (see FIG. 1); without the vertical gap, it might otherwise be necessary to let the pot drop into the box. The concave shaped relief C provides not simply an aesthetic look for the vertical gap, it can provide a curvalinear interface for abutting a circularly shaped pot 24. Preferably, the overlap tabs 44*a* include a rounded edge at the vertical gap G mainly for aesthetics.

Figure 5:
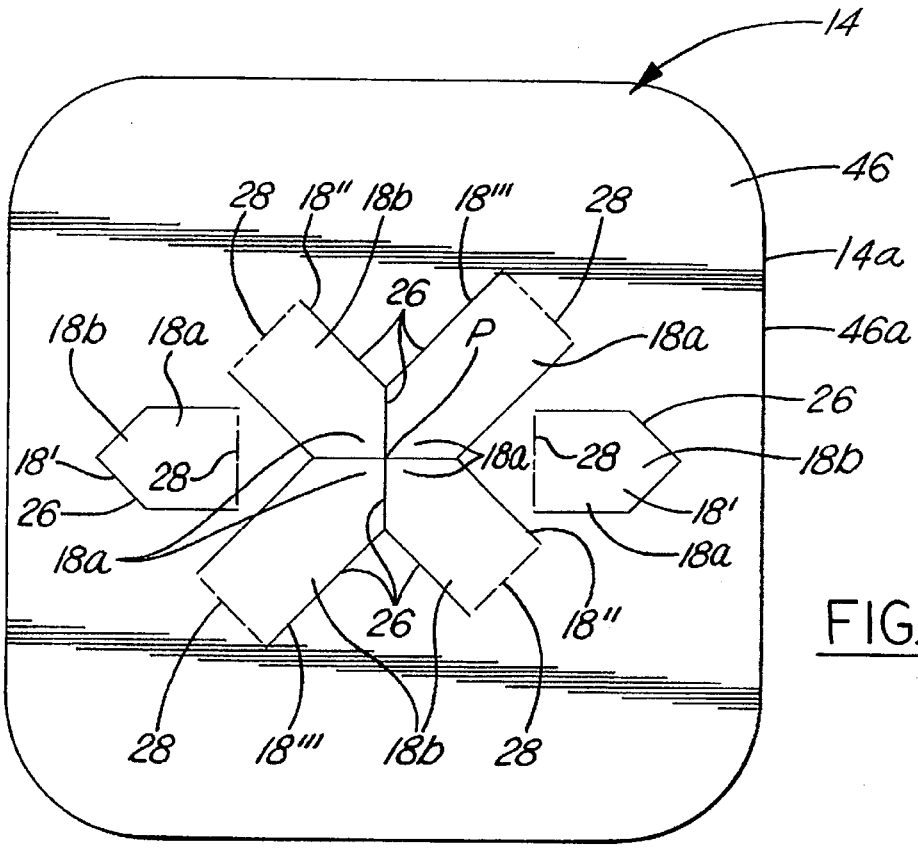
FIG. 5 is a top plan view of the base of the floral delivery box apparatus according to the present invention.

FIG. 5 refers to the structure of the preferred form of the base 14 (as depicted in FIGS. 1 and 2). The base 14 is formed from stiff flat stock material, hereinafter referred to as base stock material 46. Preferably, the base stock material 46 is composed, like the box 16, of standard corrugated paper stock material of the kind used ubiquitously in the packaging art for boxes. Of course, other materials could be used for the base stock material 46, whether corrugated or noncorrugated, including for example plastic or wax coated corrugated paper stock material or corrugated plastic stock material.

The base stock material 46 is provided with a pre-cut edge 46*a* which is predetermined to provide the perimetrical edge 14*a*. At least one pair of wings 18 is provided. Each wing 18, as indicated hereinabove, is defined by pre-cut scoring 26 and a fold-line 28 located at the terminous of the scoring. Preferably, the fold-line is pre-formed in the base stock material 46 of the base 14, but alternatively, the terminous of the scoring may provide sufficient inherent guidance for up-folding of the wing that pre-forming thereof may not be respected, such as for example if the base stock material is noncorrugated or if the terminous/fold-line is oriented parallel with the corrugation if the base stock material is corrugated; in any case, the terminous of the scoring and the fold-line are equivalent terms as used herein. Up-folding along the fold-lines results in the wings 18 being upstanding more-or-less perpendicularly with respect to the plane of the base 14, and the aforesaid upstanding orientation for both wings may be selected as being either side of the base. Each wing 18 preferably has an elongated rectangular body 18*a* with a pointed end portion 18*b* opposite the fold-line 28 thereof.

Figure 6:
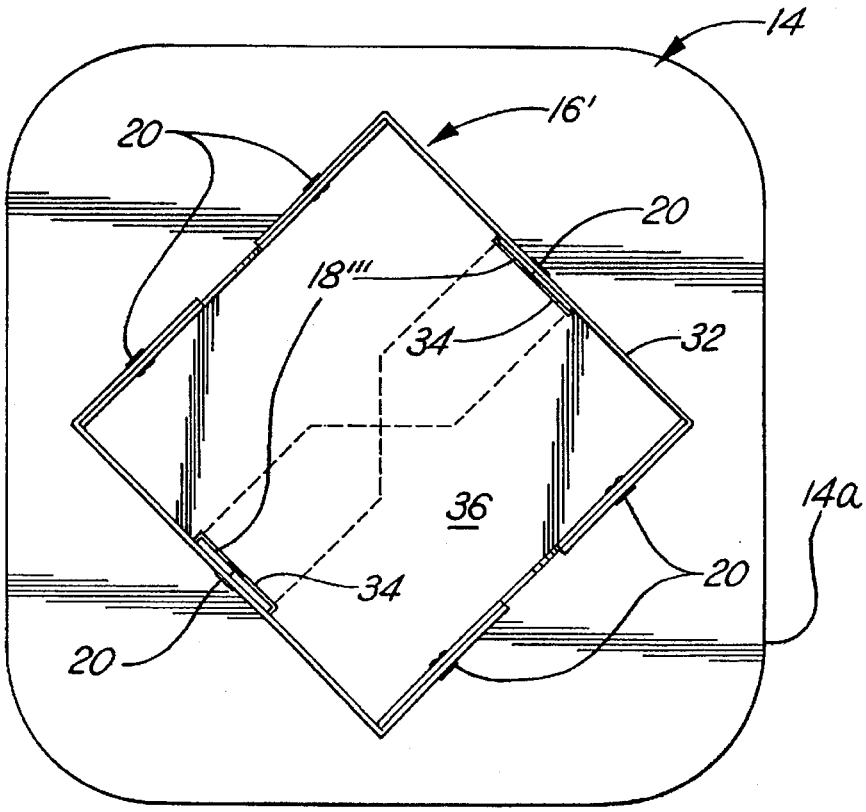
FIG. 6 is a top plan view of the floral delivery box apparatus according to the present invention, wherein a large size box is present.
Figure 7:
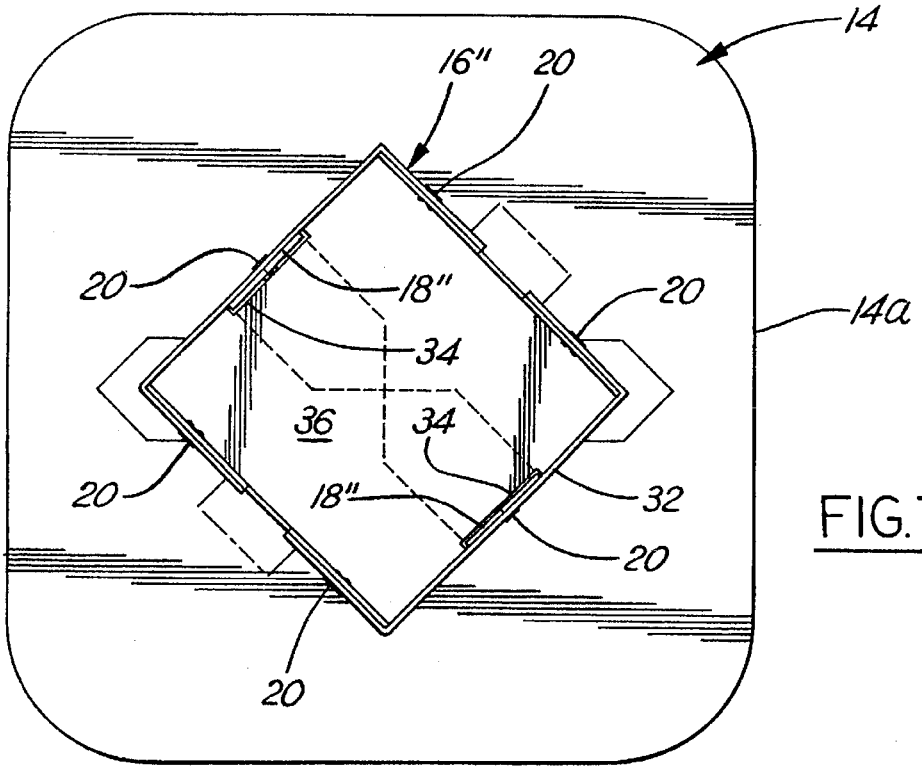
FIG. 7 is a top plan view of the floral delivery box apparatus according to the present invention, wherein a medium size box is present.
Figure 8:
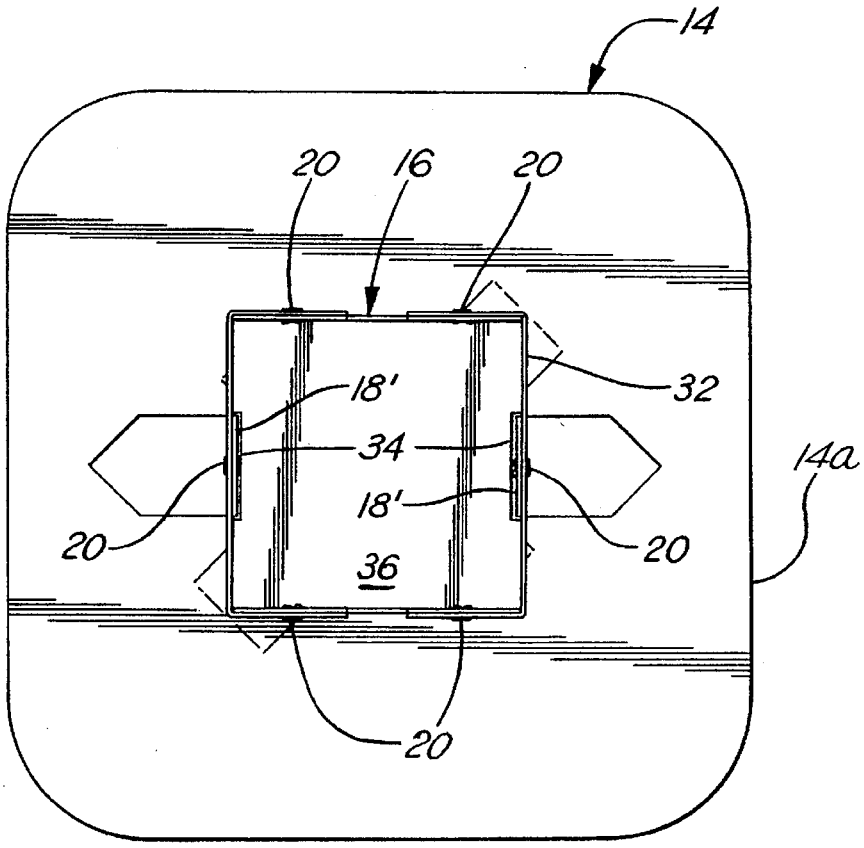
FIG. 8 is a top plan view of the floral delivery box apparatus according to the present invention, wherein a small size box is present.

It is preferred for there to be present three sets of wings 18: a first pair of wings 18' for interfacing with a small size box 16, a second pair of wings 18" for interfacing with a medium size box, and a third pair of wings 18'" for interfacing with a large size box. Other numbers of pairs of wings 18 may be provided. In each case, each pair of wings 18 has a fold-line 28 disposed perpendicular with respect to a radiant from the center point P of the box stock material 46, so as to provide abutment of the wings against the side walls of its size matching box 16, and whereupon the box is centered with respect to the perimetrical edge 14*a*, as shown in FIGS. 6, 7 and 8. In this regard, FIG. 6 depicts a large size box 16' connected with the base 14 via the third pair of wings 18'"; FIG. 7 depicts a medium size box 16" connected with the base via the second pair of wings 18"; and FIG. 8 depicts a small size box 16 (as shown at FIGS. 1 and 2) connected with the base via the first pair of wings 18'. Advantageously, as shown in FIG. 5, the pointed end portion 18*b* of two pairs of wings 18", 18'" share common scoring 26, thereby reducing scoring costs and reducing potential for weakening of the box stock material due to a multiplicity of scoring.

Figure 9B:
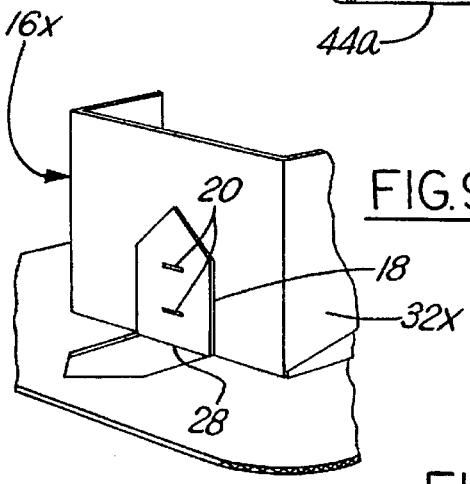
FIGS. 9A and 9B depict the floral delivery box apparatus, wherein connection of a box to the base is via wings of the base being attached to the exterior of the side walls of the box.
Figure 9A:
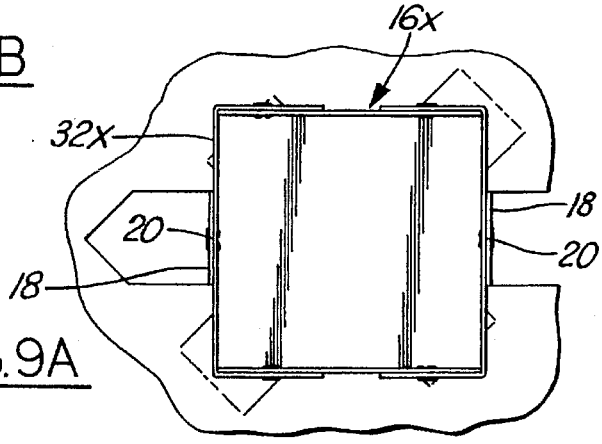

It will be noted from FIGS. 9A and 9B that the base 14 may interface with a box 16*x* having no slots in the bottom wall, wherein the fold-line 28 of the pair of wings 18 thereof places the wings at the outside surface of the side walls 32, rather than at the inside surface as would be provided by the slots as described hereinabove (or else the box 16*x* can be dimensioned to fit the placement of the fold-line 28 of the pairs of wings 18 described above). The wings 18 are connected with the side wall via staples 20. Indeed, such an arrangement makes possible the installation of a conventional floral delivery box onto the base 16.

Some dimensions will now be given merely for the purpose of instructional example (and not limitation). The base and box are each formed of corrugated "cardboard" stock material of about ⅛ thickness. The base has a cross-section of about 16 inches. Each wing of three pairs of wings has a width (along the fold-line) of about 2 inches; the length of the wings is (measured from the fold-line to the end of the pointed tip portion) about 3, 3.5 and 4.5 inches for each wing of each pair of the three pairs of wings. The fold-lines of the pairs of wings are located from the center of the base about 3, 3.625 and 4.5 inches, respectively. The boxes used in connection with the base have slots in the bottom wall and the bottom walls have cross-sections of about 6.5, 7.5 and 9.25 inches.

In operation, the florist assembles the box 16 by folding the first and second pairs of side wall tabs 42, 44, then stapling the overlap tabs 44*a* to the first pair of side wall tabs. The florist then up-folds the appropriate pair of wings 18 for the chosen box size and then pushes the wings through the slots 34 in the bottom wall 36, places the bottom wall upon the base and then staples the wings to the inside of the abutting side walls 32; alternatively, in the event the slots are not present, the wings are stapled to the outside of abutting side walls. The florist then places the pot 24 of a selected floral arrangement into the box, wherein the pot reasonably snugly fits the box so that not a lot of play is involved. The florist uses the vertical slots G so that the pot is held onto even as the pot is placed restingly onto the bottom wall of the box; typically, the pot now may abut the concave shaped relief C. Lastly, the florist places a floral wrapping 48 (see FIG. 1) about the combination of the floral arrangement and the floral delivery box apparatus, where the rounded corners 14*b* of the perimetrical edge 14*a* provide a gentle distribution of corner forces on the floral wrapping so that the integrity of the floral wrapping is maintained all during the distribution process.

Now, the combination of the floral arrangement, the floral delivery box apparatus and the floral wrapping may be picked-up by grasping the perimetrical edge of the base and/or be placed onto a resting surface of a motor vehicle via the base, and the combination of the surface area and stiffness of the base will prevent the combination from be coming damaged from handling or from tipping due to inertial forces encountered in the course of driving a motor vehicle. In this regard for example, it is preferred for the perimetrical edge of the base to have a cross-section substantially at least on the order of about 1.5 times the cross-section of the bottom wall of the box (see FIG. 6).

To those skilled in the art to which this invention appertains, the above described preferred embodiment may be subject to change or modification. Such change or modification can be carried out without departing from the scope of the invention, which is intended to be limited only by the scope of the appended claims.

What is claimed is:

1. A floral delivery box apparatus for providing resistance to tipping of a floral arrangement associated therewith, said floral delivery box apparatus comprising:

a box formed of stiff material, said box having a bottom wall and a plurality of side walls, said box having an open top opposite said bottom wall;

a base formed of flat stiff material, said base having a perimetrical edge, said base having at least one pair of wings integrally formed therein, wherein each wing of said at least one pair of wings is defined by scoring of said base, said scoring providing a terminous at each said wing within said perimetrical edge, a fold-line of each said wing being defined by said terminous, wherein said bottom wall of said box is placed upon said base, and the wings of said at least one pair of wings are up-folded in relation to said base along the fold-line thereof into abutting relation with selected opposing side walls of said plurality of side walls; and attachment means for fasteningly attaching the up-folded wings to said opposing side walls to thereby affix said box to said base;

where said perimetrical edge defines a first cross-section; wherein said bottom wall defines a second cross-section, said first, cross-section being larger than said second cross-section.

2. The floral delivery box apparatus of claim 1, wherein said bottom wall has a pair of slots formed therein adjacent said selected opposing side walls for respectively receiving therethrough the up-folded wings.

3. The floral delivery box apparatus of claim 1, wherein second selected opposing side walls of said box are each provided with a gap extending from said open top to a predetermined location between said open top and said bottom wall.

4. The floral delivery box of claim 3, where a concave notch is provided in said second selected opposing side walls at said gap thereof.

5. The floral delivery box apparatus of claim 1, wherein said perimetrical edge has rounded corners; and wherein said first cross-section is at least substantially 1.5 times said second cross-section.

6. The floral delivery box apparatus of claim 1, wherein said base has a center; and wherein each fold-line of each said wing is oriented perpendicular to a radiant from said center.

7. The floral delivery box apparatus of claim 6, wherein the fold-line of each pair of wings is formed in said base substantially equidistant from said center, and wherein the fold-lines of each pair of wings is spaced differently from that of the fold-lines of each other pair of wings.

8. The floral delivery box apparatus of claim 7, wherein said at least one pair of wings comprises:

a first pair of wings, each wing thereof having a first fold-line spaced substantially a first distance from said center;

a second pair of wings, each wing thereof having a second fold-line spaced substantially a second distance from said center; and a third pair of wings, each wing thereof having a third fold-line spaced substantially a third distance from said center;

wherein said first distance is less than said second distance and said second distance is less than said third distance.

9. The floral delivery box apparatus of claim 8, wherein each wing comprises a body integrally connected with the fold-line thereof and a pointed end portion, said pointed end portion being located opposite to, and facing away from, the fold-line thereof; wherein said pointed end portion of each said wing of said second and third pairs of wings mutually share said scoring of said base.

10. The floral delivery box apparatus of claim 9, wherein said perimetrical edge has rounded corners; and wherein said first cross-section is at least substantially 1.5 times said second cross-section.

11. The floral delivery box apparatus of claim 10, wherein said bottom wall has a pair of slots formed therein adjacent said opposing side walls for receiving therethrough the up-folded wings.

12. The floral delivery box apparatus of claim 11, wherein second selected opposing side walls of said box are each provided with a gap extending from said open top to a predetermined location between said open top and said bottom wall; and wherein a concave notch is provided in said second selected opposing side walls at said gap thereof.

13. A floral delivery box apparatus for providing resistance to tipping of a floral arrangement associated therewith, said floral delivery box apparatus comprising:

a box formed of stiff material, said box having a bottom wall and a plurality of side walls, said box having an open top opposite said bottom wall;

a base formed of flat stiff material, said base having a perimetrical edge, said base having at least one pair of wings integrally formed therein, wherein each wing of said at least one pair of wings is defined by scoring of said base, said scoring providing a terminous at each said wing within said perimetrical edge, a fold-line of each said wing being defined by said terminous, wherein said bottom wall of said box is placed upon said base, and the wings of said at least one pair of wings are up-folded in relation to said base along the fold-line thereof into abutting relation with selected opposing side walls of said plurality of side walls; and means for connecting the up-folded wings to said opposing side walls to thereby connect said box to said base;

wherein said perimetrical edge defines a first cross-section; wherein said bottom wall defines a second cross-section, said first cross-section being larger than said second cross-section; and wherein said bottom wall has a pair of slots formed therein adjacent said selected opposing side walls for respectively receiving therethrough the up-folded wings.

14. The floral delivery box apparatus of claim 13, wherein second selected opposing side walls of said box are each provided with a gap extending from said open top to a predetermined location between said open top and said bottom wall; wherein a concavely curved notch is provided in said second selected opposing side walls at said gap thereof.

15. The floral delivery box apparatus of claim 13, where said base has a center; and wherein each fold-line of each said wing is oriented perpendicular to a radiant from said center.

16. The floral delivery box apparatus of claim 15, wherein the fold-line of each pair of wings is formed in said base substantially equidistant from said center, and where the fold-lines of each pair of wings is spaced differently from that of the fold-lines of each other pair of wings.

17. The floral delivery box apparatus of claim 16, where said at least one pair of wings comprises:

a first pair of wings, each wing thereof having a first fold-line spaced substantially a first distance from said center;

a second pair of wings, each wing thereof having a second fold-line spaced substantially a second distance from said center; and a third pair of wings, each wing thereof having a third fold-line spaced substantially a third distance from said center;

wherein said first distance is less than said second distance and said second distance is less than said third distance.

18. The floral delivery box apparatus of claim 17, wherein each wing comprises a body integrally connected with the fold-line thereof and a pointed end portion, said pointed end portion being located opposite to, and facing away from, the fold-line thereof; wherein said pointed end portion of each said wing of said second and third pairs of wings mutually share said scoring of said base.

* * * * *